United States Patent [19]

Clucker et al.

[11] 3,938,679

[45] Feb. 17, 1976

[54] CONTROL SYSTEM FOR REFUSE HANDLING APPARATUS

[75] Inventors: Richard V. Clucker, Kenton; Roland R. Kennedy, Galion, both of Ohio

[73] Assignee: Harsco Corporation, Camp Hill, Pa.

[22] Filed: Apr. 27, 1973

[21] Appl. No.: 354,997

Related U.S. Application Data

[63] Continuation-in-part of Ser. No. 187,384, Oct. 7, 1971, Pat. No. 3,760,962.

[52] U.S. Cl. ..... 214/83.3

[51] Int. Cl.[2] ..... B65F 3/00

[58] Field of Search ..... 214/83.3

[56] References Cited

UNITED STATES PATENTS

| | | | |
|---|---|---|---|
| 3,615,028 | 10/1971 | Appleman et al. | 214/83.3 |
| 3,760,962 | 9/1973 | Clucker et al. | 214/83.4 |
| 3,822,797 | 7/1974 | McKenzie | 214/83.3 |

*Primary Examiner*—Robert J. Spar
*Assistant Examiner*—Donald W. Underwood
*Attorney, Agent, or Firm*—Palmer Fultz, Esq.

[57] ABSTRACT

A refuse truck of the rear loading type provided with a novel packer blade and associated control apparatus. More specifically, the packer blade is mounted on a carriage that is arranged to reciprocate on an inclined track means so as to load and pack the truck body and the blade and carriage are respectively actuated by separate hydraulic cylinders which are in turn controlled in a novel manner so as to operate the carriage and the blade through successive cycles each of which is controlled by a respective pressure responsive controller. As a result, each of said cycles is automatically terminated by the occurrence of a predetermined pressure value and the mechanism will automatically proceed to the next succeeding cycle.

3 Claims, 14 Drawing Figures

CONTROL SYSTEM FOR REFUSE HANDLING APPARATUS

REFERENCE TO RELATED APPLICATION

This application is a continuation-in part of my copending application Ser. No. 187,384 filed Oct. 7, 1971 now U.S. Pat. No. 3,760,962.

BACKGROUND OF THE INVENTION

Field of the Invention

This invention relates to refuse handling equipment and more particularly to rear load type refuse trucks provided with a novel packing apparatus.

SUMMARY OF THE INVENTION

In general the refuse truck of the present invention includes a body comprising a forward refuse receiving body portion and a rear body portion communicating with said forward body portion and provided with a novel packer blade and associated control apparatus.

In accordance with the present invention the packer blade is pivotally mounted on a carriage that is arranged to reciprocate on an inclined track means so as to load and pack the forward body portion and the blade and carriage are respectively actuated by separate hydraulic cylinders which are in turn controlled in a novel manner so as to operate the carriage and the blade through successive cycles each of which is controlled by a respective pressure responsive controller. As a result, each of said cycles is automatically terminated by the occurrence of a predetermined pressure value and the mechanism will automatically proceed to the next succeeding cycle.

It is a primary aspect of the present invention to provide a novel control system for a refuse packer that provides auto-cycle operation for the packer blade, as well as selective manual actuation of the packer blade which manual actuation can be instituted at any stage of the auto-cycle operation merely by actuating an emergency stop means for the auto-cycle operation.

As another aspect of the present invention the novel control system is uniquely adapted to maintain pressurization of the packer blade even when such blade is prevented from moving into its intended operative position by engagement with an unpackable foreign object. In such instance the blade temporarily yields to permit the blade to move past the object. After the object is cleared by the yielded blade such continued pressurization immediately returns the blade to its desired operative position for the remainder of the interrupted stroke.

As another aspect of the present invention, the above mentioned plurality of pressure responsive controllers, that respectively control a plurality of cycles, so as to be subsequently pressure triggered by predetermined system pressure values.

As still another aspect of the present invention, when the packer blade is being moved through one of the above mentioned cycles, wherein it is caused to first engage the refuse and in the event it engages a foreign object that becomes jammed between said blade and the bottom wall of the loading opening, then in that event the respective pressure responsive controller for such cycle will automatically permit termination of movement of the blade actuating cylinder responsive to a predetermined system pressure value. At the same time, the next successive or blade retraction cycle will automatically be negotiated whereby the packing blade is dragged freely past said foreign object and will then automatically move to its packing position.

As another aspect of the present invention, the present novel control system has a decided advantage in that it is adapted to proceed from an interrupted cycle of movement to the next successive cycle of the packing blade without the necessity of reversing the mechanism back to its prior path of movement. As a result the movement of the blade is terminated and the carriage can be moved to drag the arrested packing blade past the refuse.

As still another aspect of the present invention, the novel control system is so arranged that if movement of the packing blade is manually stopped during a refuse engaging cycle, and then restarted by the operator, the packing blade will always raise away from engagement with an obstructing object, let such object re-position itself, after which the blade will automatically take a new pressurized engagement with such re-positioned object.

As still another aspect of the present invention, the novel control system, being pressure responsive, eliminates the need for limit switches and mechanical linkages to actuate control valve. Such elements have been sources of mechanical trouble in prior devices in that they have the tendency to become worn and distorted whereby the accuracy of control is lost.

It is therefore a primary object of the present invention to provide a novel control system for a refuse packer adapted for auto-cycle operation which can be interrupted during any stage of the cycle to permit an instant emergency stop as well as selective manual operation of the packing blade.

It is another object of the present invention to provide a novel control system for a refuse packer which maintains pressurization of the packer blade, for the remainder of the stroke of the blade, after such blade has been interrupted and displaced by an unpackable foreign object.

It is another object of the present invention to provide a refuse truck provided with a packer blade and novel associated control mechanism adapted to automatically move said blade through successive pressure controlled cycles.

It is another object of the present invention to provide an apparatus of the type described wherein said control mechanism is further adapted to stop said blade at any position and subsequently restart movement of said blade so as to cause the blade to return to and complete certain of its cycles in predetermined priority and sequence.

It is still another object of the present invention to provide an apparatus of the type described wherein a fluid actuated packing blade is automatically arrested at a predetermined systems pressure in the event it engages a foreign object that obstructs its path of movement.

It is still another object of the present invention to provide an apparatus of the type described which is adapted to automatically proceed through subsequent cycles after the packing blade has become arrested by striking a foreign object during a refuse engaging cycle.

It is another object of the present invention to provide an apparatus of the type described wherein the packing blade will, when stopped and restarted, automatically raise off the refuse and then again proceed to move into force transmitting engagement therewith.

It is another object of the present invention to provide an apparatus of the type described wherein the packing blade can be stopped during a refuse engaging cycle and the next succeeding cycle in the path of movement can be negotiated without the necessity of reversing the path of movement of the apparatus.

It is another object of the present invention to provide an apparatus of the type described that is of simple construction requiring only a minimum of adjustments to prepare the machine for operational use.

It is still another object of the present invention to provide an apparatus of the type described that eliminates the need for mechanically actuated limit switches as well as mechanical linkages for automatically actuating valve elements.

It is still another object of the present invention to provide an apparatus of the type described that has an improved control system that incorporates a single spool control valve for efficiently and economically accomplishing all of the above mentioned control functions.

Further objects and advantages of the present invention will be apparent from the following description, reference being had to the accompanying drawings wherein preferred forms of embodiments of the invention are clearly shown.

DESCRIPTION OF THE PREFERRED EMBODIMENTS

Figure 1:
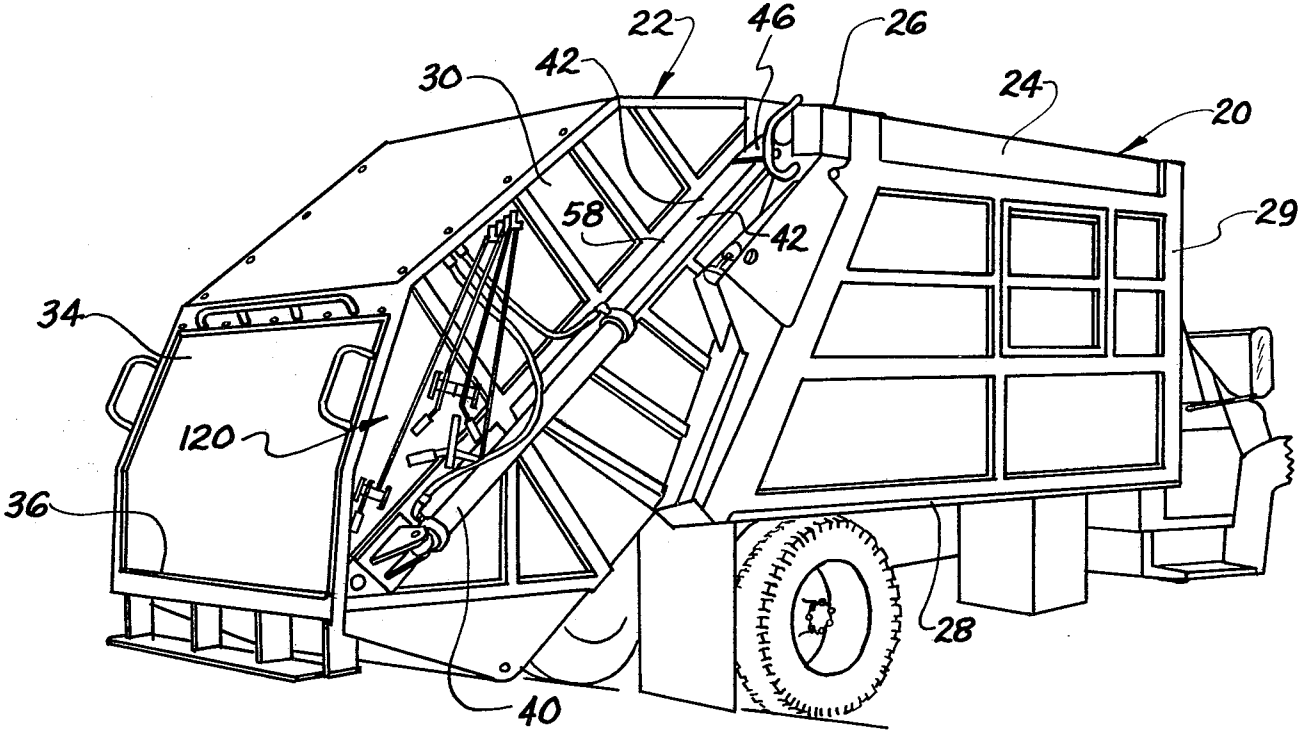
FIG. 1 is a partial rear perspective view illustrating a rear loader type refuse truck to which the apparatus of the present invention has been applied.
Figure 2:
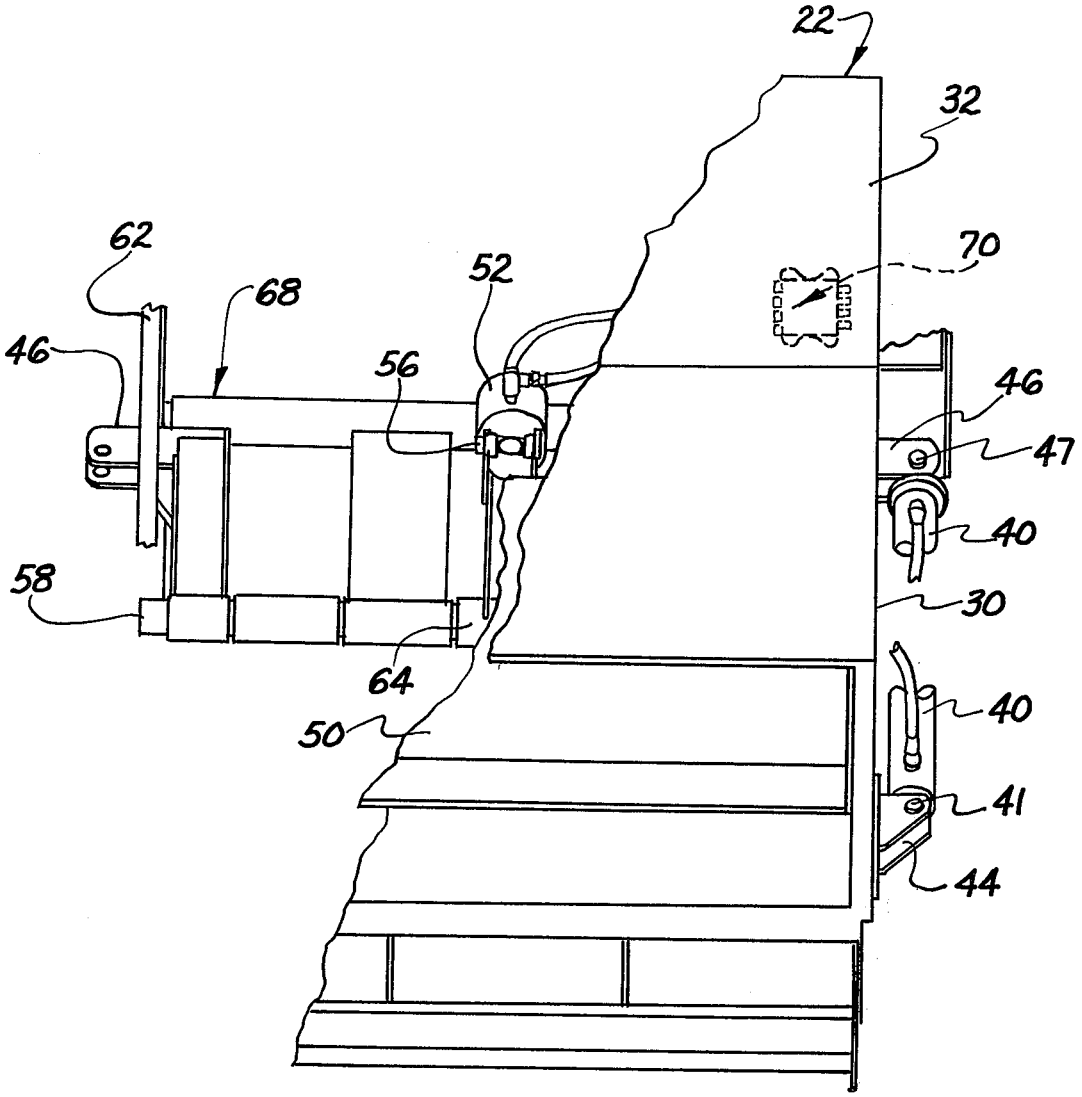
FIG. 2 is a partial rear view, in broken section, showing the packer blade and carriage apparatus comprising a portion of the present invention.
Figure 3:
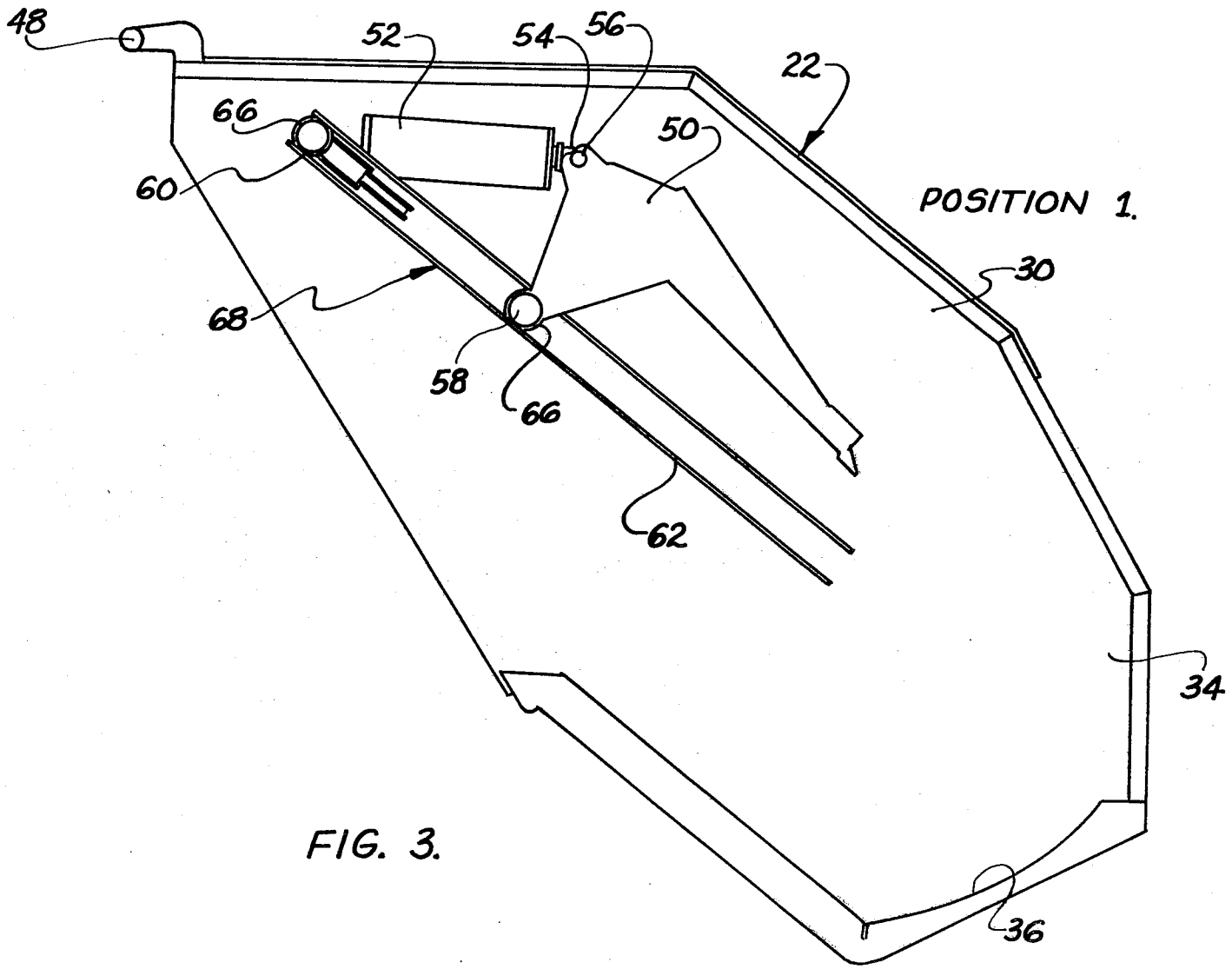
FIGS. 3 through 6 are side sectional views of a rear body portion and apparatus of FIG. 2, the section being taken along a vertical plane through the centerline of such body portion.

Referring in detail to the drawings, FIGS. 1 and 2 illustrate a rear loader type refuse truck that includes a forward refuse receiving body portion indicated generally at 20 and a rear packer body portion indicated generally at 22. Rear body portion 22 is pivotally attached to the forward body portion 20 at a pivot 48, FIG. 4, and a hydraulic cylinder 21 is operatively connected between the forward and rear body portions at the pivots 23 and 25. Rear body portion 22 can be pivotted upwardly and away from front body portion 20 by extension of hydraulic cylinder 21 thereby permitting unloading of front body portion 20 after it has been packed with refuse.

With continued reference to FIG. 1, forward body portion 20 includes side walls 24, a top wall 26, a bottom wall 28 and a front wall 29 which define a refuse receptable into which the packing apparatus on the rear body portion 22 functions to load and pack refuse.

Referring next to FIGS. 2 – 6, rear body portion 22 includes a carriage indicated generally at 68 which is mounted for reciprocation on inclined tracks 62 supported by side walls 30 of rear body portion 22.

Carriage 68 includes an upper shaft 60, the ends of which are provided with rollers 66 that run in track 62 and a lower shaft 58, the ends of which are provided with similar rollers 66 which also are mounted in the track.

Carriage 68 further includes outwardly extending brackets 46 which are pivotally attached to a pair of carriage actuating hydraulic cylinders 40 at the pivot pins 47. The lower end of hydraulic cylinders 40 are similarly pivotally attached to the side wall 30 of the rear body portion by the pivot pins 41 in brackets 44. It will now be understood that when carriage actuating cylinders 40 are pressurized in their upper chambers then cylinder rods 42 and carriage 68 are retracted downwardly and, conversely, when the other ends of the cylinders 40 are pressurized the cylinder rods and carriage will be extended upwardly.

With reference to FIGS. 2 through 6, a packing blade 50 includes collars 64 which are pivotally mounted on shaft 58 and a blade actuating cylinder 52 includes an inner end pivotally mounted on carriage 68 at upper shaft 60 and an extendable ram 54, the outer end of which is pivotally connected to packer blade 50 at a pivotal connection 56. It will now be understood that when blade actuating cylinder 52 is pressurized so as to extend ram 54 the packing blade will be pivotted about lower shaft 58 from Position 2 to Position 3. Conversely when the other side of cylinder 52 is pressurized so as to withdraw ram 54, then packer blade 50 will be raised from Position 3 to Position 2.

It should be mentioned that the operators load refuse into the rear body portion 22 via a rear opening 34 such that the refuse is disposed on a bottom wall 36.

In general, when packing blade 50, just described, moves from Position 2 to Position 3 blade 50 will engage the refuse and, during a subsequent cycle, later to be described, when carriage actuating cylinder 40 is extended to raise carriage 68 from Position 3 to Position 4 then the refuse is further moved up into the previously described receptacle formed by forward body portion 20. As the forward body portion becomes filled the carriage actuating cylinders 40 serve to compress and pack the load.

AUTOMATIC OPERATION OF THE CONTROL SYSTEM

1. Neutral

As seen in the flow diagrams of FIGS. 7–11, a pump 74 driven by the vehicle engine provides pressurized fluid for the system. Fluid from pump 74 is delivered to a pressure responsive control means for effecting auto-cycle operation that includes a main control valve indicated generally at 70. When an actuator handle 72 is in its neutral position, FIG. 7, spool 75 is centered whereby the central grooves in the spool connect an inlet 78 with an outlet 80 leading back to tank 76.

In the neutral position, both outlet ports 82 and 84 are closed by spool 75 whereby blade actuating cylinder 52 and carriage actuating cylinders 40 are locked with the packing blade in Position 4.

2. Cycle 1

Figure 8:
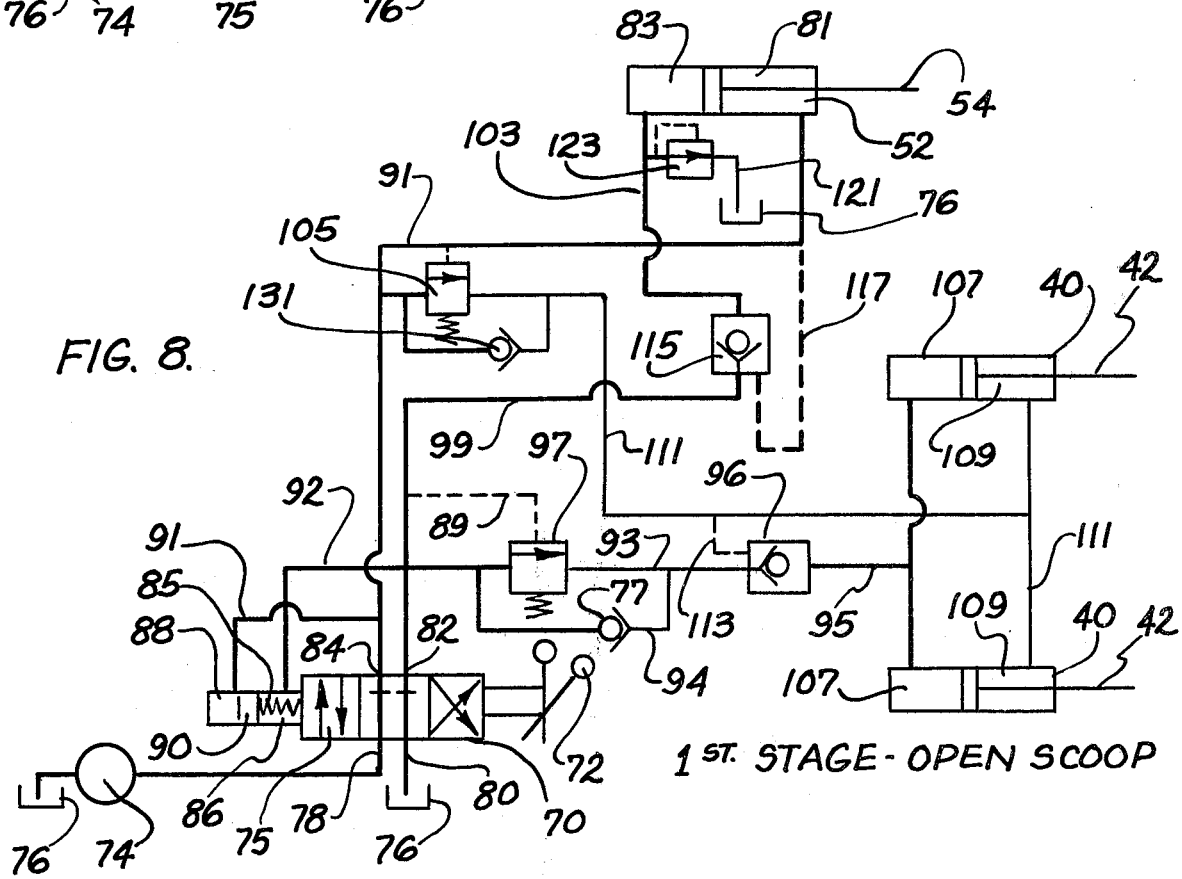
FIG. 8 is a second diagrammatic view of the control system for the refuse machine of the preceding figures.

When actuator handle 72 is moved to the right, FIG. 8, the control system undergoes its first cycle.

During cycle 1 packer blade 50 is moved from Position 4 to Position 1 and only the blade actuating cylinder 52 is pressurized in a direction to retract the ram 54 of such cylinder.

With continued reference to FIG. 8, movement of actuator 72 connects valve inlet 78 with line 91 which delivers pressurized oil to chamber 81 of blade actuating cylinder 52 as shown by the heavy character of line 91 which is then pressurized.

As seen in FIG. 8, the other chamber 83 of blade actuating cylinder 52 is drained to tank via line 103, check valve 115 and line 99. This is accomplished by the opening of pilot operated check valve 115 which senses pressure in line 91 via pilot 117.

3. Cycle 2

The function of cycle 2 is to move carriage 68 from Position 1 to Position 2 by pressurizing only the retraction chamber 109 of carriage actuating cylinders 40.

Figure 9:
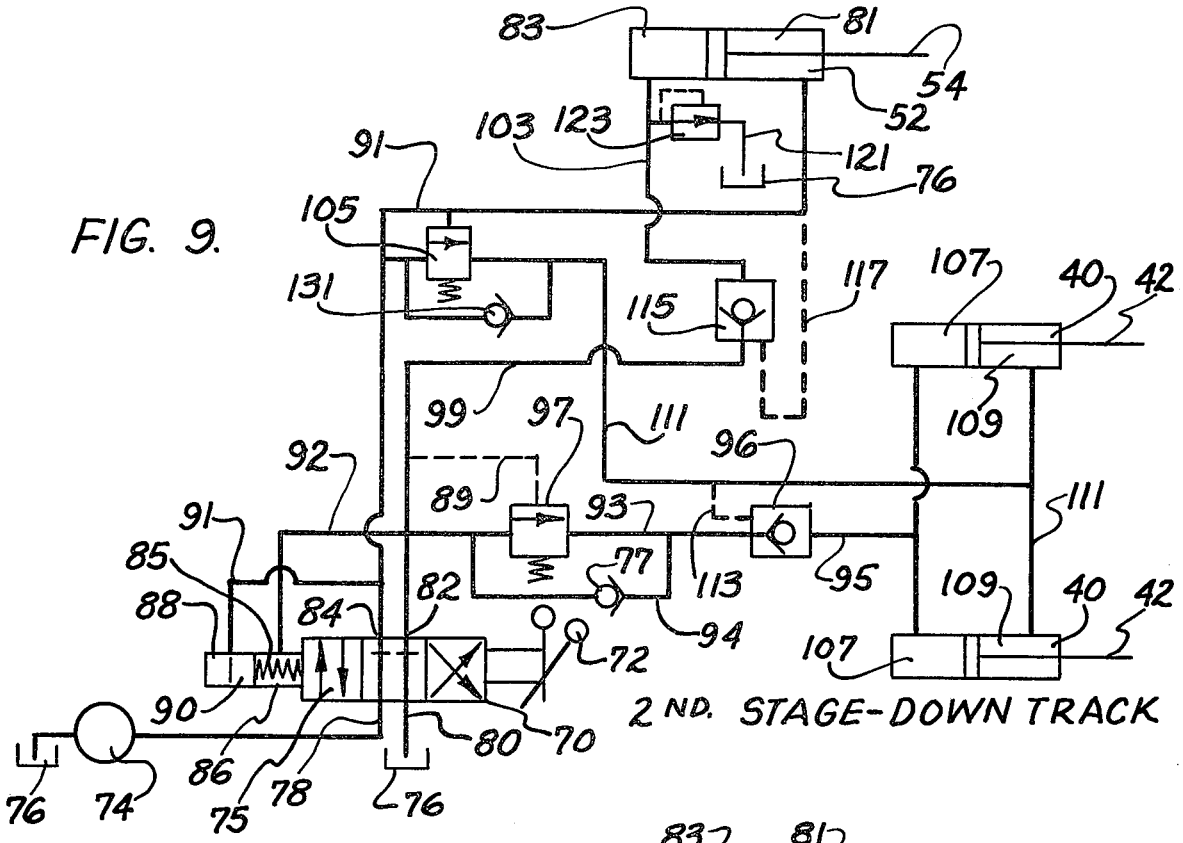
FIG. 9 is a third diagrammatic view of the control system for the refuse machine of the preceding figures.

The circuit flow for cycle 2 is illustrated in FIG. 9. When the pressure in line 91 builds up to a predetermined pressure value, for example 600 psi, then a pressure responsive valve 105 opens and delivers pressurized oil to the chambers 109 of carriage actuating cylinders 40 via the line 111. This serves to move the packing blade 50 down track means 68 from the position of FIG. 3 to the position of FIG. 4.

It should be mentioned that the other chambers 107 of cylinders 40 are drained to tank via line 95, pilot check valve 96, line 93, line 94, check valve 77, line 99 and control valve ports 82 and 80 to tank. Pilot check valve 96 includes pilot line 113 that senses pressure in line 111 and is opened thereby.

4. Cycle 3

Figure 4:
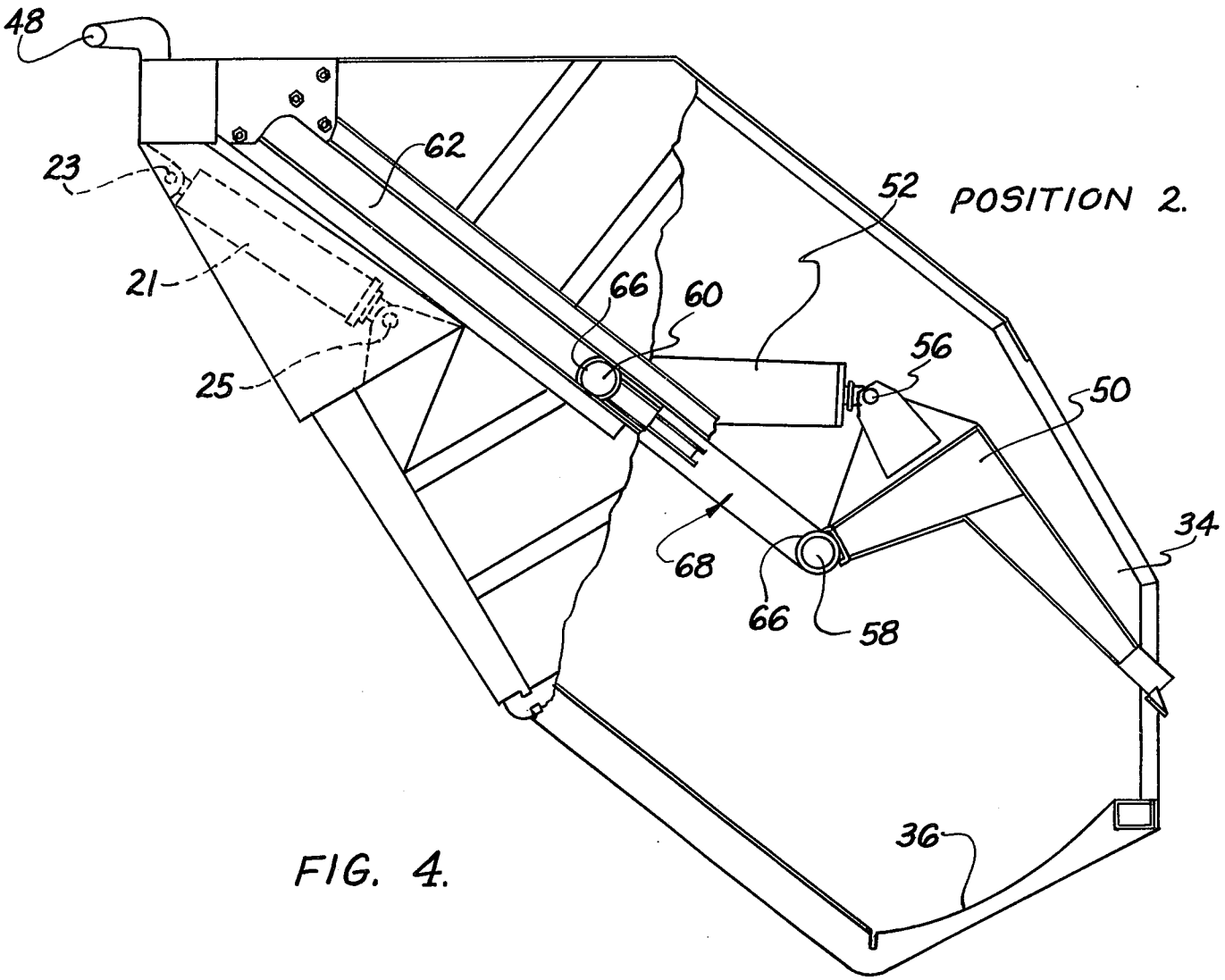
Figure 5:
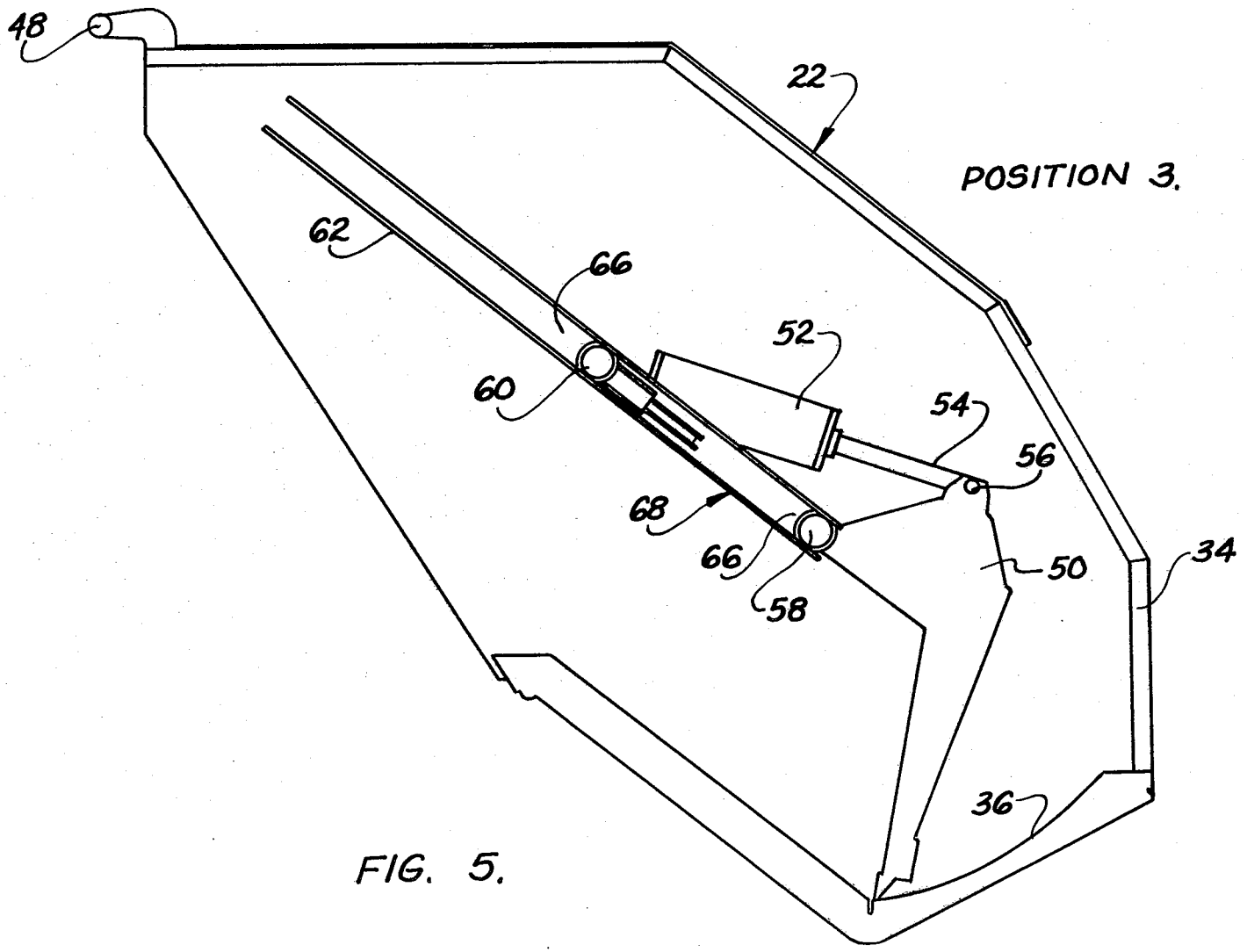
Figure 6:
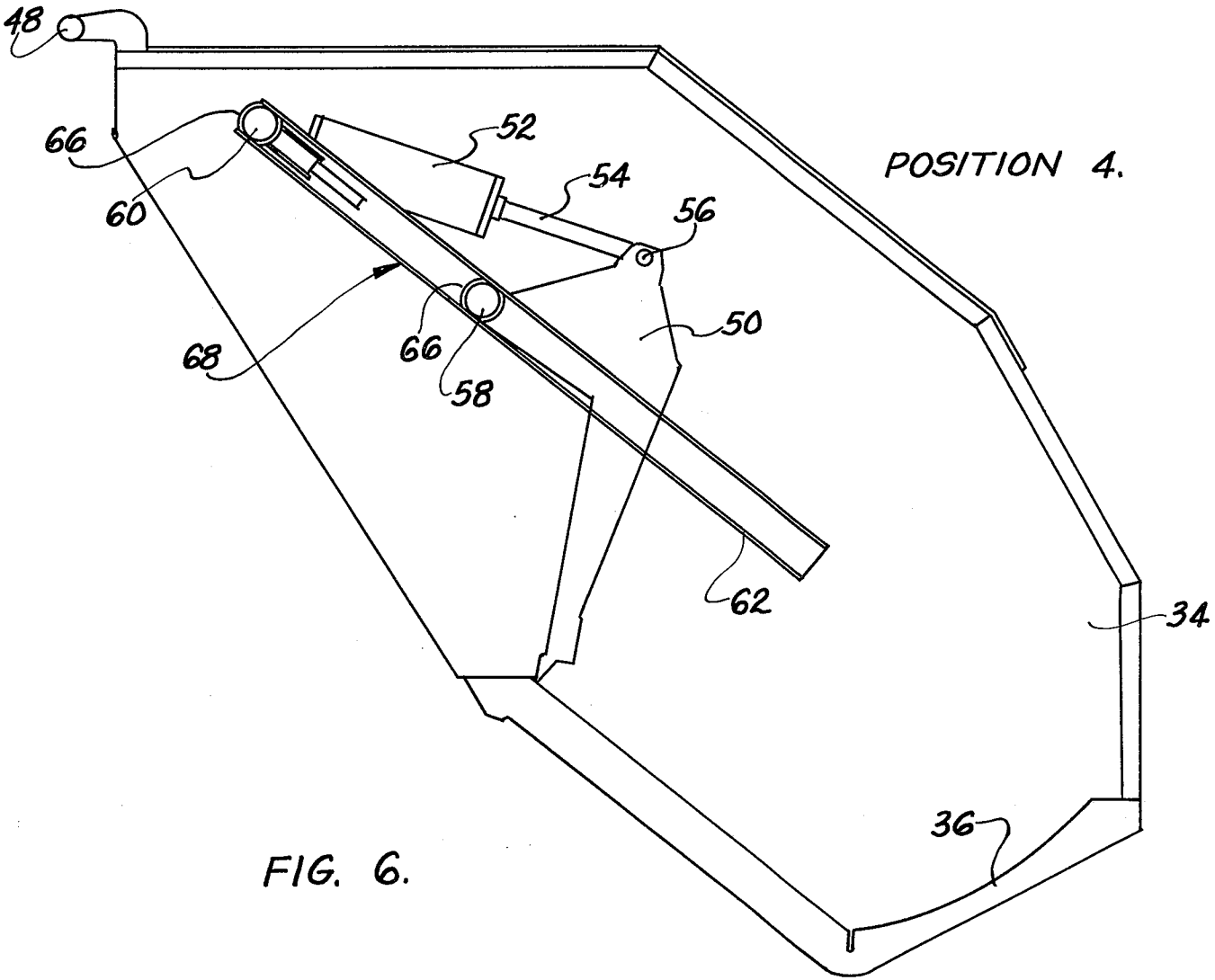

During this cycle packer blade 50 is moved from its raised Position 2 of FIG. 4 to its lowered Position 3 of FIG. 5.

Figure 10:
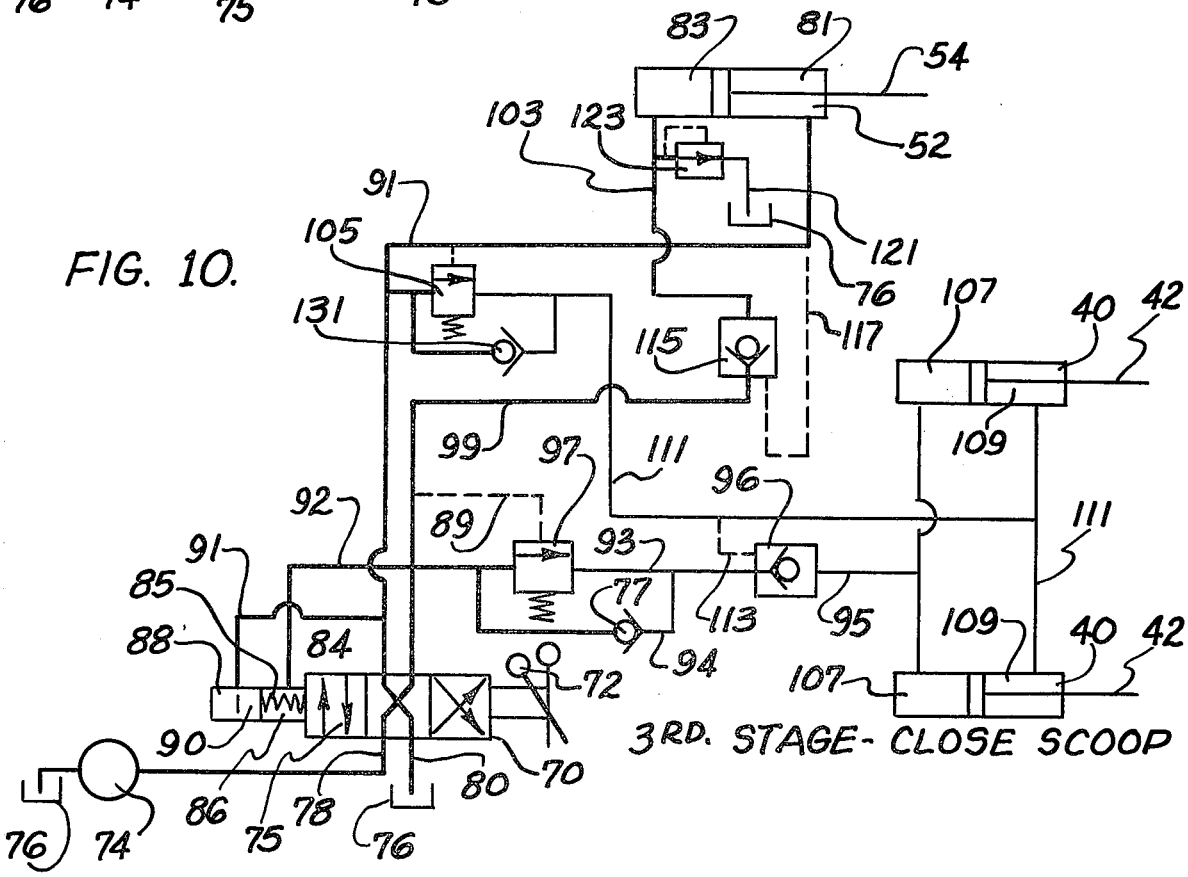
FIG. 10 is a fourth diagrammatic view of the control system of the refuse machine of the preceding figures.

The circuit for cycle 3 is illustrated diagrammatically in FIG. 10.

When the system pressure builds up to a predetermined pressure value, at the termination of the cycle of FIG. 9, for example 800 psi, in line 91, the chamber 88 of valve shifting mechanism 90 is pressurized so as to release detents, not illustrated, that permit spring 85 to automatically shift spool 75 through center and to the left connecting control valve inlet 78 with line 99 leading to chamber 83 of blade actuating cylinder 52. Also, when spool 75 is shifted to the left, FIG. 10, chamber 81 of blade actuating cylinder 52 is drained to tank via line 91 which is connected to tank via ports 84 and 80 of main control valve 70.

The above described circuit connection, shown by heavy solid delineation, serves to extend rod 54 of blade actuating cylinder 52 and thereby lower the packing blade from Position 2 to Position 3.

It should further be mentioned that when the packing blade is being lowered and is jammed by encountering a foreign object of refuse, pressure will build up to a predetermined value, for example 1,000 psi, at pressure responsive valve 97. When such pressure value is exceeded and pressure responsive valve 97 opens, fluid is diverted to chambers 107 of carriage actuating cylinders 40 which serve to move the packing blade past the obstruction.

5. Cycle 4

Figure 11:
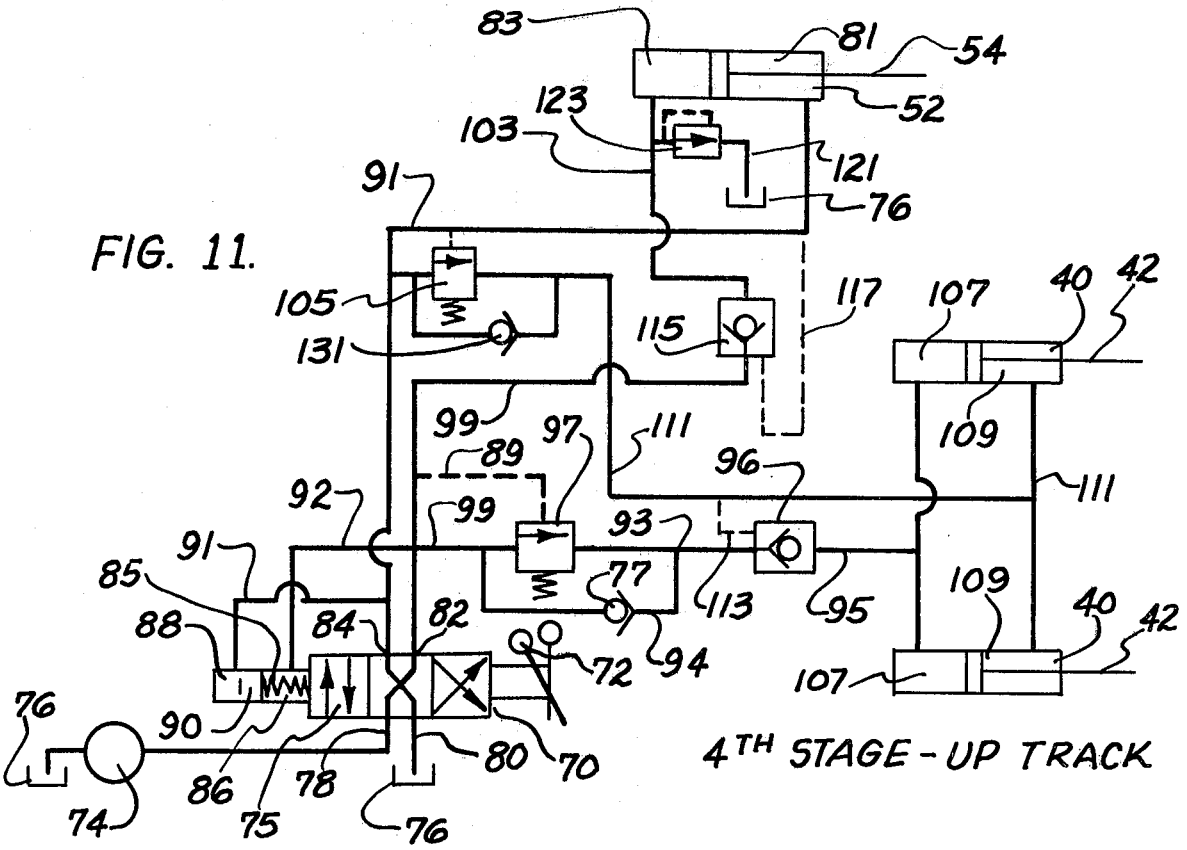
FIG. 11 is a fifth diagrammatic view of the control system of the refuse machine of the preceding figures.

During this cycle carriage 68 is moved from its lower Position 3 to its upper Position 4 for the purpose of packing the load and chamber 107 of carriage actuating cylinder 40 are pressurized by the cycle 4 shown in FIG. 11.

When the predetermined pressure, for example 1,000 psi, opens pressure responsive valve 97 responsive to pilot line 89 sensing pressure in line 99, the chamber 107 of carriage actuating cylinders 40 are pressurized via pump 74, ports 78 and 82, line 99, pressure responsive valve 97, line 93, check valve 96, and line 95 leading to chambers 107.

Figure 7:
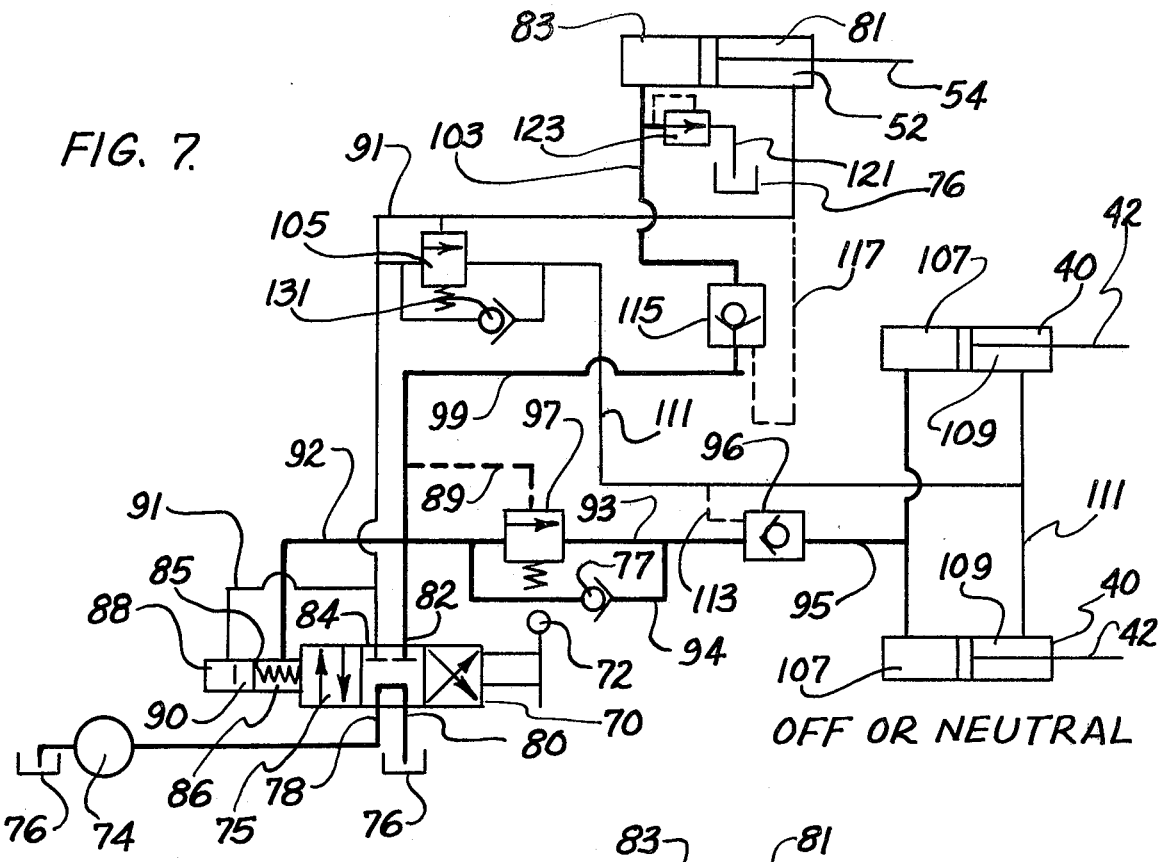
FIG. 7 is a diagrammatic view of the control system for the refuse machine of the preceding figures.

This serves to pack the load and when the packing pressure reaches a predetermined value, for example 1,200 psi, in the line 99, then chamber 86 of valve shifting mechanism 90 is pressurized via line 92 thereby shifting spool 75 of main control valve 70, together with actuator 72, back to the neutral position of FIG. 7 which terminates the packing cycle 4.

MANUAL OPERATION OF THE CONTROL SYSTEM

Figure 12:
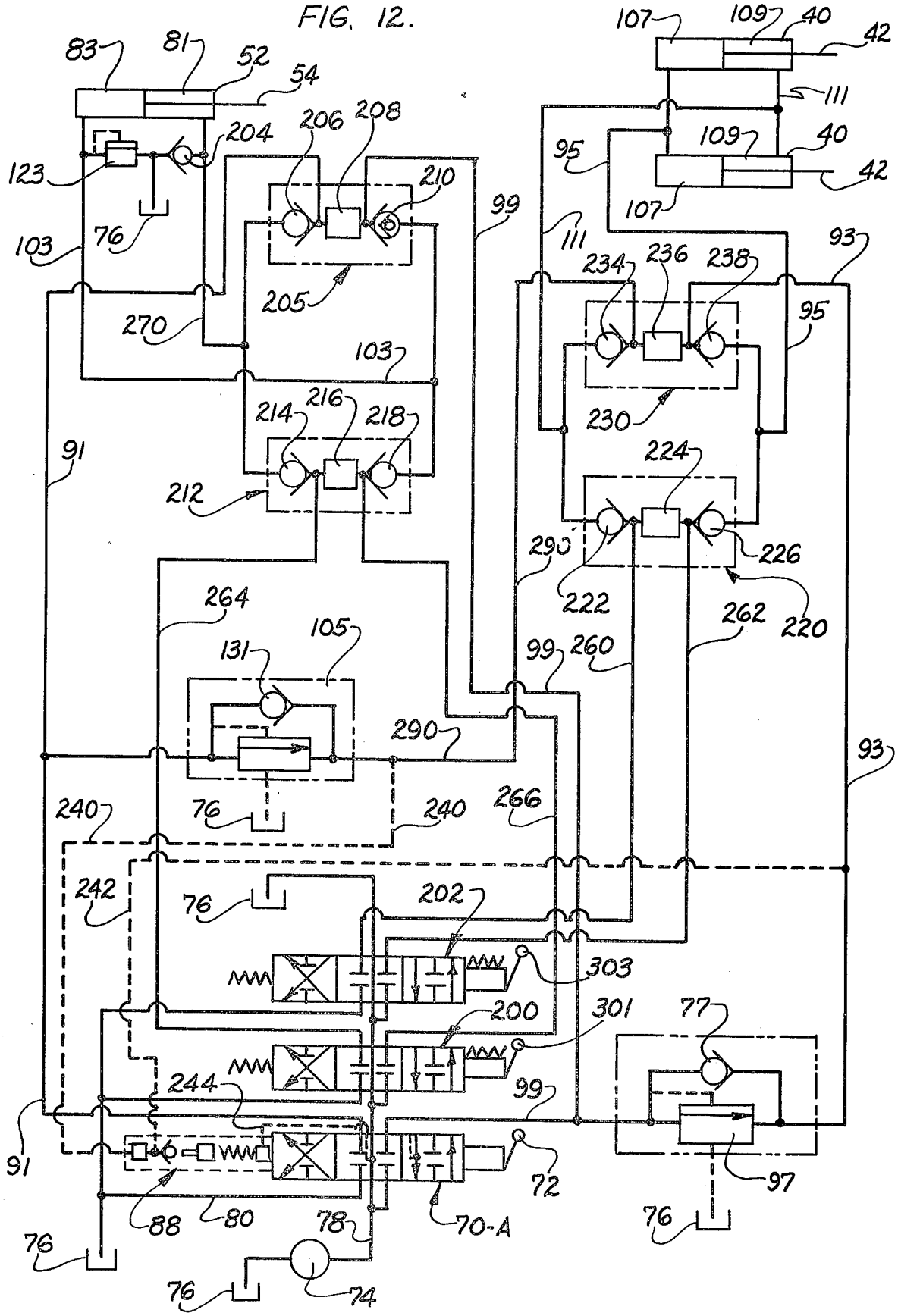
FIG. 12 is a diagrammatic view of a modified control system constructed according to the present invention and adapted to provide emergency stop and manual operation upon operator imposed interruption of the auto-cycle.

Reference is next made to FIG. 12, which shows a modified control system which, in general, provides in addition to auto-cycle operation, the selective manual operation of either the pivotting of the packer blade or the advancement and retraction of the packer blade.

Figure 13:
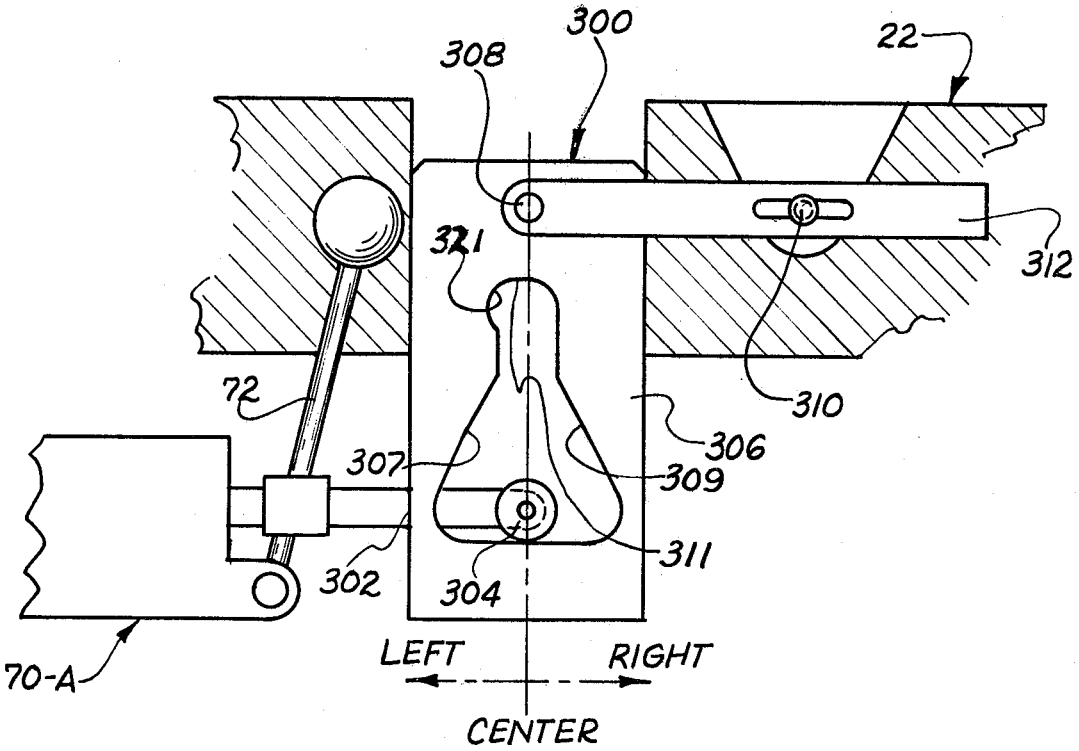
FIG. 13 is a diagrammatic view of an emergency stop controller comprising a component of the modified system of FIG. 12.

In addition, the modified system of FIG. 12 includes a unique emergency stop mechanism shown in detail in FIG. 13, which can be utilized as a safety device by pushing the emergency stop actuating lever close to the loading opening when the men engaged in loading are at times subjected to unusual dangerous situations.

As seen in FIG. 12 the modified control system includes a main or auto-cycle valve indicated generally at 70-A which is in the form of a four-way valve which continuously receives pressurized fluid from a fluid motor 74. The system further includes a packer blade pivot control valve 200 which when manually actuated serves to raise and lower the previously mentioned packer blade 50. This valve 200 is also a four-way valve.

There is an additional load packing fluid control valve 202, of the four-way type, that is also manually controlled and it functions to manually advance and retract packer blade 50 along its track as previously described.

When auto-cycle control valve 70-A is in the position illustrated with the other two valve 200 and 202 also centered, fluid motor 74 merely circulates oil through all three valves and then back to tank 76.

Auto-cycle operation is started by shifting manual actuator 72 of valve 70-A to the right whereby pressurized fluid is delivered by lines 78 and 91 and then through double pilot check assembly 205 and line 270 to chamber 81 of blade actuating fluid motor 52. This serves to raise packing blade 50. The path of oil return is from chamber 83 via line 103, check 210 of assembly 205, line 99, valve 70-A and line 80 to tank.

When the packing blade is fully raised pressure responsive valve 105 opens at a predetermined pressure, for example 1,300 psi, and delivers oil via line 290 to a double pilot check assembly 230 and then via line 111 to chambers 109 of load packing fluid motor 40. This moves the packing blade down its track as previously described.

When load packing fluid motors 40 are fully retracted pilot line 240 is pressurized which shifts auto-cycle control valve 70-A to its extreme left position.

Pressurized fluid from pump 74 is then delivered via lines 78 and 99 through double pilot check assembly 205 to line 103 and into chamber 83 of blade actuating fluid motor 52. This serves to lower the packing blade to its closed position.

With the packing blade 50 fully lowered a pressure responsive valve 97 is pressurized which delivers oil via line 93 to double pilot check assembly 230 and then via line 95 to chambers 107 of load packing fluid motor 40. This moves the blade 50 up its track 68 and packs the material into the body. When blade 50 reaches the end of the above mentioned packing stroke then pressure builds up in pilot line 242 sufficiently to force the spool of auto-cycle control valve 70-A back to its neutral position. This is the completion of one-auto-cycle.

It should be mentioned that the double pilot check assemblies 205, 212, 220, and 230 mentioned above are of a conventional nature and include an operating piston 208, 216, 224, and 236 which in the instances of each valve opens either of its respective check valves. For example, the double pilot check assembly 205 operating piston 208 opens either left check valve 206 or right check valve 210, depending upon which end of the pilot piston is subjected to the higher fluid pressure.

With respect to FIG. 12 the elements 214 and 218; 222 and 226; and 234 and 238 are ball check valves comprising portions of the double pilot check assemblies 212, 220, and 230 respectively.

It will be noted from the drawing that when packer blade pivot control valve 200 is manually actuated fluid is delivered to fluid motor 52 via lines 264 or 266 and a double pilot check assembly 212 to a respective chamber 81 or 83 of blade actuating fluid motor 52.

For manual actuating of load packing fluid motor 40, manual actuator 303 is shifted to the right or left so as to actuate load packing fluid control valve 202, either to the right or left, so as to deliver fluid through another double pilot check assembly 220 and thence via lines 111 or 95 to respective chamber 109 or 107 of load packing fluid motor 40.

It should be mentioned that the fully automatic, non-manual system of FIGS. 7–11 previously described, can be provided with pilot operated check valves in lines 91 and 111 in the same manner as shown in the manual-auto system of FIG. 12 where pilot operated check 206 is provided between lines 91 and 270, and where pilot operated check 234 is provided between lines 111 and 290. Such valves may be added in the event there is a tendency for the packing blade or carriage to drift during portions of the cycle.

Reference is next made to FIG. 13 which illustrates an emergency stop means, indicated generally at 300, which comprises a mechanism for quickly centering auto-cycle control valve 70-A and thereby immediately rendering it inoperative so as to terminate auto-cycle operation.

As is best seen in FIG. 13 the spool of valve 70-A comprises an axially shiftable rod 302 which is connected to the spool and includes a cam follower 304.

The mechanism further includes a cam means 306 which includes cam surfaces 307 and 309 and a follower lock recess 311. When roller 304 is in a left position, during auto-cycle, and lever 312 is manually actuated, then cam surface 307 moves downwardly and engages follower 304 and shifts it to a centered position. The converse is true when lever 312 is actuated with the spool of valve 70-A in a right position. It should be further mentioned that actuating lever 312 is pivotted to the rear body portion 22 of the refuse packer at a pivot 310 and the left end of lever 312 is pivotted to cam means 306 at a pivot 308.

When the lever 312 is actuated to center valve 70-A follower 304 enters follower lock recess 311 whereby the valve is locked in the emergency centered position by a detent 321.

In operation, when the system of FIG. 12 is undergoing an auto-cycle operation as described above, it is necessary to actuate the emergency stop mechanism 300 in order to permit operation of the packer blade pivot control valve 200 and load packing control valve 202.

Figure 14:
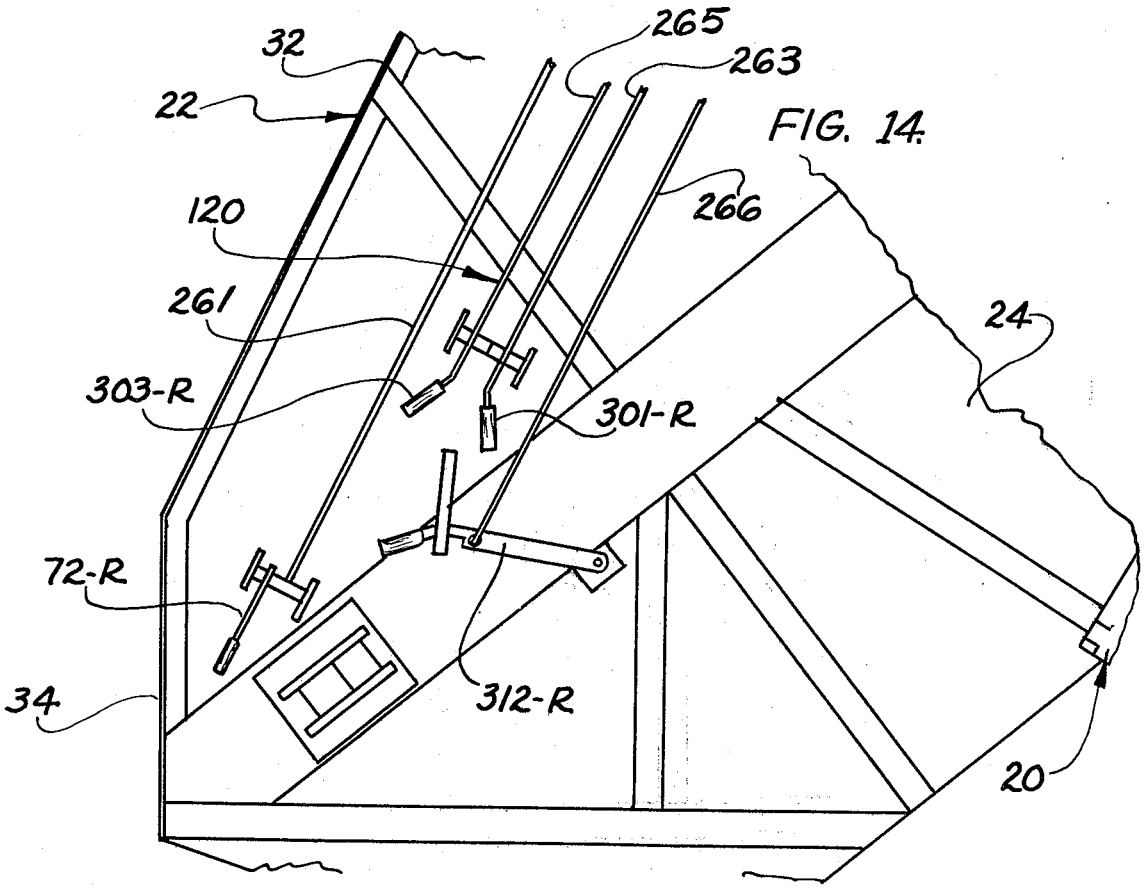
FIG. 14 is a side elevational view of a control panel comprising a portion of the present invention.

Reference is next made to FIGS. 1 and 14 which illustrate a manual control panel for the previously described hydraulic system of FIG. 12 which panel is indicated generally at 120 and provides manual actuating levers for both auto-cycle and manual operation of the packer blade.

It will be understood that standard portions of the manual control panel 120 can be utilized with the auto-cycle, non-manual hydraulic system of FIGS. 7–11. However for purposes of this disclosure the complete hydraulic system of FIG. 12 shall be described.

Referring in detail to FIG. 14, a remote auto-cycle control handle 72-R is mounted on side wall 24 of the rear body portion 22 and is connected to previously mentioned auto-cycle control handle 72, FIG. 12, by control rod 261, FIG. 14.

With continued reference to FIG. 14, remote control handles 301-R and 303-R are provided for manual control valves 200 and 202 and connected to the handles 301 and 303, FIG. 12, by control rods 263 and 265 respectively.

Referring to FIGS. 13 and 14, the emergency stop system 300 is also actuated from control panel 120 by a remote emergency stop lever 312-R mounted on body side wall 24 and connected to the previously described emergency stop lever 312, FIG. 13.

It will now be understood that all of the functions of the auto-cycle, manual system of FIG. 12 can be selectively started and stopped from the central control panel 120 merely by the operator's selection of the appropriate remote levers 72-R, 301-R, 303-R, and 312-R.

It should further be mentioned that the present novel control system of FIG. 12 includes a feature for maintaining packer blade 50 pressurized in the event that it encounters an unpackable foreign obstruction such as a 4 × 4 beam wedged in the packer body. When packer blade 50 is being lowered during which may be termed phase 3 of the cycle as described above and such blade hits a foreign obstruction chamber 83 of blade actuating fluid motor 52 will remain pressurized even though pressure responsive valve 97 diverts oil. When the foreign object is cleared away packer blade 50 will immediately close to its intended operating position for the rest of the cycle.

With continued reference to FIGS. 7–11, pressure responsive valve 123 has a line 121 leading to tank.

Also, in FIGS. 7–11, it will be noted that pressure responsive valve 105 has a check valve 101 in parallel with it.

While the forms of embodiments of the present invention as herein disclosed constitute preferred forms, it is to be understood that other forms might be adopted.

What is claimed is:

1. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected top said packer blade; a load packing fluid motor operatively connected to said packing blade for reciprocating said packer blade to compact the load; pressure responsive control means for automatically sequentially operating said fluid motors to move said packing blade between raised and lowered positions, and for advancing and retracting said packing blade between load engaging and retracted positions, said pressure responsive control means including a main auto-cycle control valve means and a plurality of pressure responsive valves arranged in circuit with said first and second fluid motors for sequentially energizing said fluid motors to cyclically operate through a plurality of packing cycles, said main auto-cycle control valve means comprising a single spool four-way valve including an inlet communicating with a source of pressurized fluid, a first outlet for delivering pressurized fluid to certain chambers of said fluid motors when said spool of said four-way valve is in a first position and a second outlet for delivering pressurized fluid to certain other chambers of said fluid motors when said spool of said four-way valve is in a second position, said four-way valve including a third centered spool position wherein both of said outlets are isolated from said source of pressurized fluid; a pressure responsive feedback controller that automatically shifts said main auto-cycle control valve means between said positions responsive to the occurrence of predetermined pressure values encountered by said system; emergency stop means for shifting said main auto-cycle control valve to said third control position; and a manual actuator for operating said emergency stop means; and a manual packer blade control valve downstream of said auto-cycle control valve means and in circuit with said blade actuating fluid motor and a manual load packing control valve downstream of said auto-cycle control valve means and in circuit with said load packing fluid motor whereby said auto-cycle control valve means isolates said manual control valves from the pressurized fluid when said auto-cycle valve means is in said closed position.

2. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected to said packer blade; a load packing fluid motor operatively connected to said packing blade for reciprocating said packer blade to compact the load; pressure responsive control means for automatically sequentially operating said fluid motors to move said packing blade between raised and lowered positions, and for advancing and retracting said packing blade between load engaging and retracted positions, said pressure responsive control means including a main auto-cycle control valve means and a plurality of pressure responsive valves arranged in circuit with said first and second fluid motors for sequentially energizing said fluid motors to cyclically operate through a plurality of packing cycles, said main auto-cycle control valve means comprising a four-way valve including an inlet communicating with a source of pressurized fluid, a first outlet for delivering pressurized fluid to certain chambers of said fluid motors when said four-way valve is in a first position and a second outlet for delivering pressurized fluid to certain other chambers of said fluid motors when said four-way valve is in a second position, said four-way valve including a third centered position wherein both of said outlets are isolated from said source of pressurized fluid; a pressure responsive feedback controller that automatically shifts said main auto-cycle control valve means between said positions responsive to the occurrence of predetermined pressure values encountered by said system; emergency stop means for shifting said main auto-cycle control valve to said third control position; a manual actuator for operating said emergency stop means; a manual packer blade control valve in circuit with said blade actuating fluid motor; a manual load packing control valve in circuit with said load packing fluid motor; a "blade actuating" valve actuator for said first manual control valve; and a "load packing valve" actuator for said second manual control valve.

3. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected to said packer blade; a load packing fluid motor operatively connected to said packing blade for reciprocating said packer blade to compact the load; pressure responsive control means for automatically sequentially operating said fluid motors to move said packing blade between raised and lowered positions, and for advancing and retracting said packing blade between load engaging and retracted positions, said pressure responsive control means including a main auto-cycle control valve means and a plurality of pressure responsive valves arranged in circuit with said first and second fluid motors for sequentially energizing said fluid motors to cyclically operate through a plurality of packing cycles, said main auto-cycle control valve means comprising a four-way valve including an inlet communicating with a source of pressurized fluid, a first outlet for delivering pressurized fluid to certain chambers of said fluid motors when said four-way valve is in a first position and a second outlet for delivering pressurized fluid to certain other chambers of said fluid motors when said four-way valve is in a second position, said four-way valve including a third centered position wherein both of said outlets are isolated from said source of pressurized fluid; a pressure responsive feedback controller that automatically shifts said main auto-cycle control valve means between said positions responsive to the occurrence of predetermined pressure values encountered by said system; emergency stop means for shifting said main auto-cycle control valve to said third control position; a manual actuator for operating said emergency stop means; a manual packer blade control valve in circuit with said blade actuating fluid motor; a manual load packing control valve in circuit with said load packing fluid motor; a "blade actuating" valve actuator for said first manual control valve; and a "load packing valve" actuator for said second manual control valve, said manual packer blade control valve and said manual load packing control valve each including a respective inlet communicating with said pressurized flow from said four-way valve only when said four-way valve is in said third centered position.

* * * * *